United States Patent [19]

Yamada et al.

[11] Patent Number: 5,033,884

[45] Date of Patent: Jul. 23, 1991

[54] WIRE DOT PRINTER HEAD WITH OIL ABSORBING MEMBER

[75] Inventors: Tetsuhiro Yamada; Masahiro Tatsukami; Hirokazu Andou; Tatsuya Koyama, all of Tokyo, Japan

[73] Assignee: Oki Electric Industry Co., Ltd., Tokyo, Japan

[21] Appl. No.: 400,055

[22] Filed: Aug. 29, 1989

[30] Foreign Application Priority Data

Aug. 29, 1988 [JP] Japan ..... 63-112092[U]

[51] Int. Cl.[5] ..... B41J 2/24

[52] U.S. Cl. ..... 400/124; 400/701

[58] Field of Search ..... 400/124, 701

[56] References Cited

U.S. PATENT DOCUMENTS

| | | | |
|---|---|---|---|
| 3,889,793 | 6/1975 | Cattaneo | 400/124 |
| 3,893,220 | 7/1975 | Bittner | 400/124 |
| 3,907,092 | 9/1975 | Kwan et al. | 400/124 |
| 4,010,836 | 3/1977 | Bernardis et al. | 400/124 |
| 4,023,663 | 5/1977 | Engler | 400/124 |
| 4,226,544 | 10/1980 | Davenport et al. | 400/124 |
| 4,511,269 | 4/1985 | Takahashi et al. | 400/124 |
| 4,687,355 | 8/1987 | Ikehata et al. | 400/124 |

FOREIGN PATENT DOCUMENTS

| | | | |
|---|---|---|---|
| 220765 | 12/1983 | Japan | 400/124 |
| 122165 | 6/1985 | Japan | 400/124 |

*Primary Examiner*—David A. Wiecking

*Attorney, Agent, or Firm*—Wenderoth, Lind & Ponack

[57] ABSTRACT

A wire dot printing head includes armatures each of which is coupled to a printing wire, a felt guide for reducing the friction between the printing wires and a printing wire guide, a residual sheet disposed over a magnetic core frame, a biasing leaf spring, and a oil leakage preventing member. Such member is disposed over the armatures to intercept oil flowing from the felt guide. An erroneous dot printing operation due to the arms of the leaf spring sticking to the residual sheet is prevented.

5 Claims, 3 Drawing Sheets

WIRE DOT PRINTER HEAD WITH OIL ABSORBING MEMBER

BACKGROUND OF THE INVENTION

1. Field of the Invention

The present invention relates to a wire dot printing head for a serial printer, and more particularly to a wire dot printing head with a dot print missing prevention mechanism.

2. Description of the Prior Art

A conventional wire dot printing head has a mechanism wherein a wire fixing armature is supported operably by a biased leaf spring which is attracted to a core of an electromagnet against the elastic force of the leaf spring by a permanent magnet, and the armature is released by activating the electromagnet during a printing operation to cancel the magnetic flux from the permanent magnet. Generally, the wire dot printing head includes a printing wire guide which is formed of an oil impregnated felt material to prevent wear between printing wires and wire guiding elements.

When the conventional wire dot printing head is operated for a high duty printing operation, ie. for a relatively long period of time, the temperature of the wires increases. This causes oil to flow from the felt due to a decrease in the viscosity of the oil, and the oil passes through spaces between the printing wires because of capillary phenomena. The oil will leak into a space between a residual sheet and the biased leaf spring. As a result, sometimes this oil will cause the biased leaf spring to stick to the residual sheet. This can result in some dot-print operations not being performed.

SUMMARY OF THE INVENTION

An object of the present invention is to provide an improved wire dot printing head to overcome the above mentioned disadvantages.

Another object of the present invention is to provide a wire dot printing head which is capable of preventing missing or skipping of dot printing due to oil sticking a residual sheet to a biasing leaf spring.

A wire dot printing head according to the present invention comprises armatures having wires each of which is securely connected to a respective armature tip. A core is mounted to face the armatures. A biasing leaf spring is connected securely to the armatures and is supported in a cantilever manner. A coil is wound on the core for generating magnetic flux by electrical activation, to cancel a magnetic flux from a permanent magnet. An oil absorbing member is positioned between the armatures and a core guide for preventing oil from flowing along the wires to the armatures.

DESCRIPTION OF THE PREFERRED EMBODIMENTS

Figure 1:
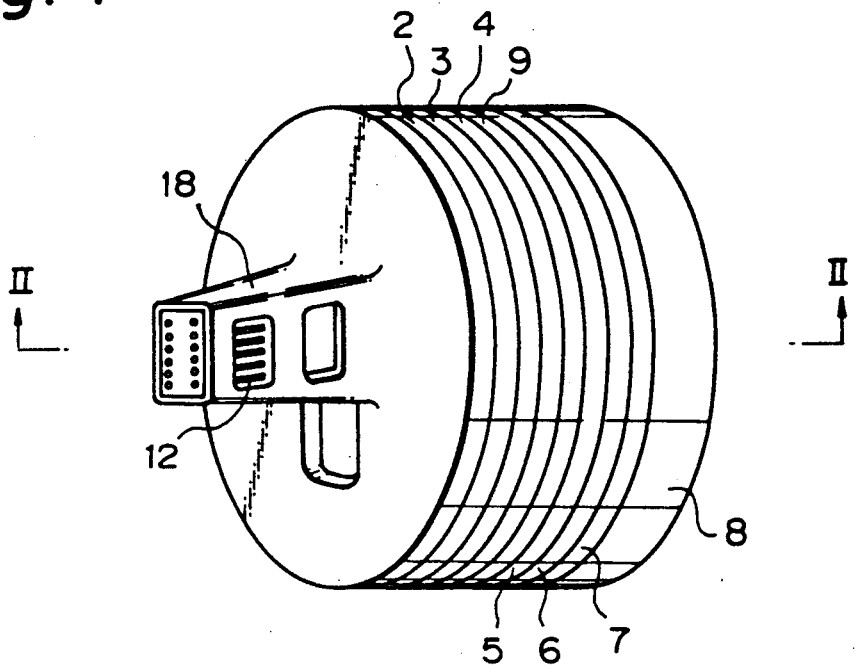
FIG. 1 is a general respective view showing a wire dot printing head according to the present invention.
Figure 2:
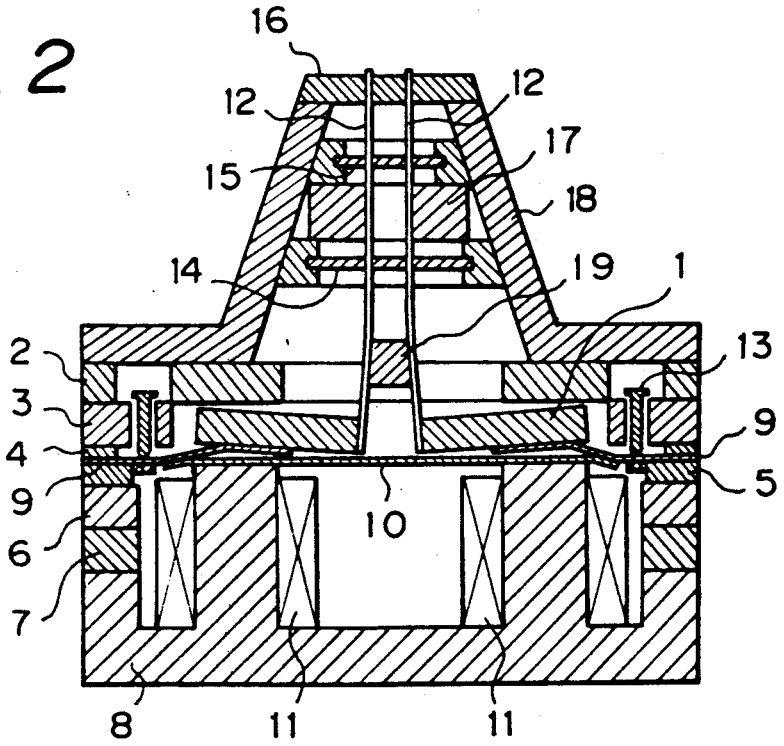
FIG. 2 is a sectional view of the wire dot printing head taken along line II—II in FIG. 1.

Referring to FIGS. 1 and 2, an embodiment of the present invention will be explained.

In FIGS. 1 and 2, a wire dot printing head comprises a plurality of armatures 1, a first ring yoke 2, a second ring yoke 3, a first ring magnetic spacer 4, a second ring magnetic spacer 5, a third ring magnetic spacer 6, and a ring permanent magnet 7. A core frame 8 forms a magnetic flux circuit together with the above mentioned components.

A biasing leaf spring 9 has a plurality of arms or tongues extending toward a middle portion thereof, and is formed by punching from a sheet of steel. The armatures 1 are welded to respective inner ends of the arms of the leaf spring 9. The armatures 1 preferably may be formed of steel or silicon steel. The leaf spring 9 is supported in a cantilever manner so that ends of the armatures 1 are tilted to one side.

The armatures 1 are attracted to an end of the core frame 8 against the elastic force of the biasing leaf spring 9 by a magnetic attracting force which is generated by the permanent magnet along the magnet flux circuit.

A residual sheet 10 prevents wear between the biasing leaf spring 9 and the end of a core frame 8. The residual sheet 10 preferably may be formed of a silicon steel. A demagnetizing coil 11 is wound on the core frame 8. The coil 11 also generates a magnetic flux in a direction opposite to that of the permanent magnet to release the attractive force of the armatures toward the core frame 8.

Figure 3:
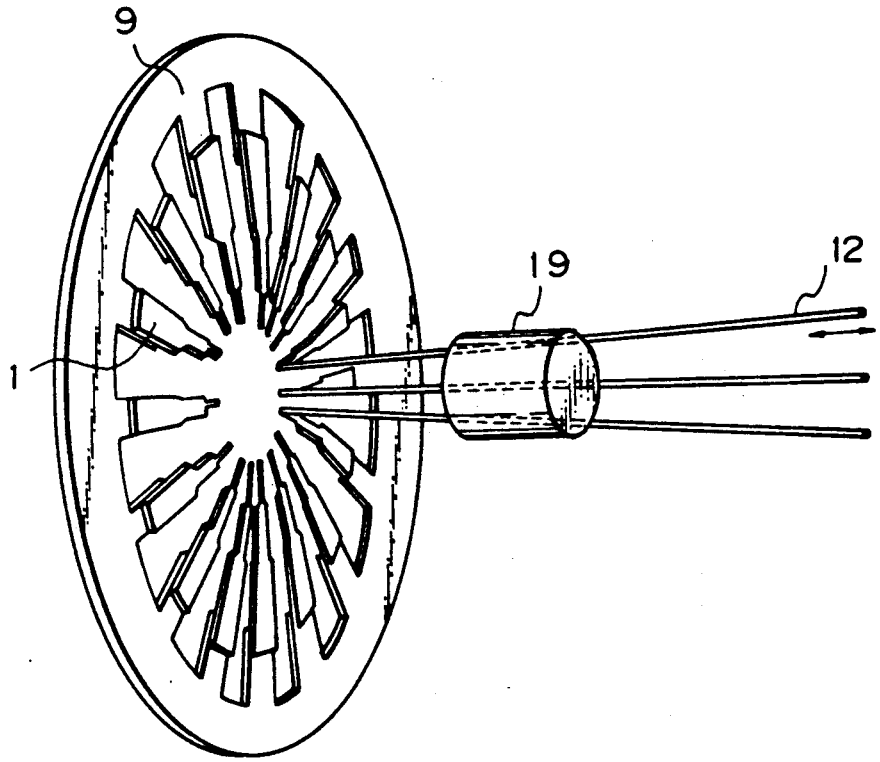
FIG. 3 is a perspective view showing a relationship among armatures, dot printing wires and oil absorbing material.

As shown in FIG. 3, wires 12 are fixedly connected to the ends of the armatures 1. When a selected one of the armatures 1 is released from the end of the core frame 8, the corresponding wire 12 dot-prints by impacting against a printing medium by way of an ink ribbon. The wires 12 are formed, for example, of a superalloy or a high-speed tool steel.

Screws 13 are mounted on the second yoke 3 to adjust the impact force of each wire 12 on the printing medium upon release of the respective armature 1. Each screw 13 is directed toward an edge of the biasing leaf spring 9, and the impact force of the respective wire 12 can be controlled by adjusting the relative position or depth of the screw 13 with respect to the respective armature. The dot printing head also includes a first intermediate guide 14, a second intermediate guide 15, and an edge guide 16. An oil permeated or penetrated felt guide member 17 is disposed between the intermediate guides 14 and 15. The felt guide member 17 supplies an oil or a lubricant to the sliding portions of the wires between the guides 14 and 15 to reduce friction and to prevent wear of the guide opening therein and of the wires. A head frame 18 supports the edge guide 16.

Figure 4:
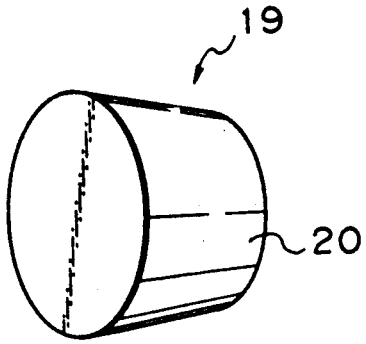
FIG. 4 is a perspective view of an oil flow prevention member according to the present invention.

A member 19 is arranged between the armatures 1 and the first intermediate guide 14 closest thereto to prevent oil from reaching the armatures and is surrounded and supported by the wires 12. The member 19 preferably may be made of an oil absorbing material such as felt, and has a tapered outer frusto-conical annular side wall 20, as shown in FIG. 4, positioned with a longer diameter end directed toward armatures 1 and a smaller diameter end directed away therefrom.

During a dot printing operation, when the demagnetizing coil 11 is in an unexciting state, the magnetic flux from the permanent magnet 7 passes through the magnetic flux circuit formed by the yokes, the magnetic spacers, the armatures 1, and the core frame 8. The magnetic force attracts the armatures 1 to the core frame 8, with the arms of the leaf spring 9 being flexed toward core frame 8. On the other hand, when the demagnetizing coil 11 is excited for a selected armature 1, the magnetic flux from the coil 11 cancels the magnetic flux from the permanent magnet 7, so that the respective arm of the leaf spring 9 is released from the flexed condition. As a result, the wire 12 corresponding to the selected armature 1 is driven to print a dot print on a printing medium by way of an ink ribbon.

During a printing operation, oil from the oil soaked felt guide 17 may flow along the wires toward the armatures due to capillary action between the wires and a lowered viscosity of the oil caused by a temperature increase of the wires at a high duty rate of printing. However, the member 19 intercepts and absorbs such oil and prevents it from flowing into the area between the bias leaf spring 9 and the residual sheet 10. Hence the member 19 is capable of preventing a wrong-dot printing operation that otherwise might be caused by arms of the bias leaf spring 9 sticking to the residual sheet 10 due to oil accumulated thereat.

A second embodiment according to the present invention will be explained with reference to FIG. 5 and 6.

Figure 5:
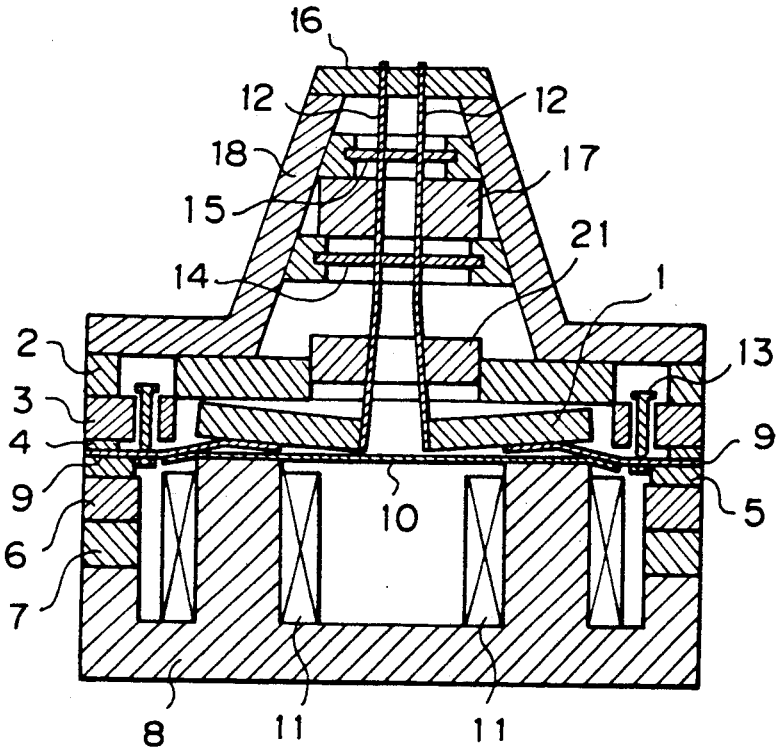
FIG. 5 is a sectional view of another embodiment of a wire dot printing according to the present invention.
Figure 6:
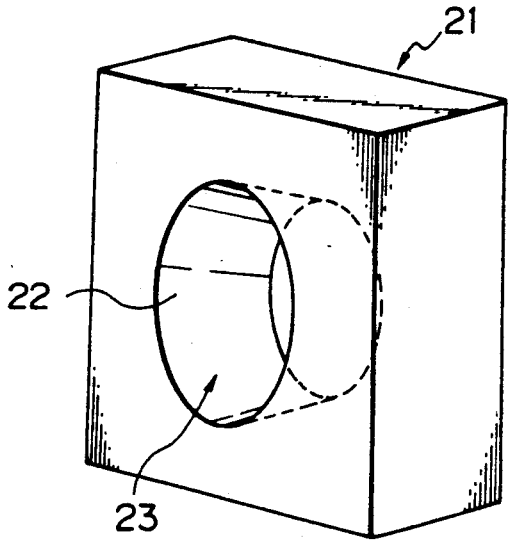
FIG. 6 is a perspective view of another embodiment of an oil flow prevention member according to the present invention.

FIG. 5 is a sectional view of a wire dot printing head showing the second embodiment according to the present invention. In FIG. 5, the same numerals represent the same elements as those shown in FIG. 2. FIG. 6 is a perspective view of an oil elevation or flow preventing member employed in the second embodiment of the present invention.

In FIG. 5, the member 21 is, for example, of rectangular form with a tapered opening 23 with a longer end directed toward armatures 1 and a smaller end directed away therefrom, and is made of an oil absorbing material such as felt. As seen in FIG. 5, the member 21 is arranged between the first intermediate guide 14 and the armatures 1 and surrounds all the wires 12. The member 21 also can provide the same advantages as the member 19 of the first embodiment. Namely, oil flowing along the wires toward the armatures 1 is prevented from entering the space between the leaf spring 9 and the residual sheet 10 because the member 21 traps and absorbs the travelling oil along the way. Therefore it is possible to prevent the armatures from becoming immovable due to adhesion of arms of the leaf spring to the residual sheet caused by sticking of the oil therebetween.

As described above, the wire printing head according to the present invention provides an improved printing operation during a long period of time of printing.

It should be noted that the present invention is not be limited to the above embodiments, and that various modifications may be possible within the concept of the present invention.

What is claimed is:

1. In a wire dot printing head including a biasing leaf spring supporting a plurality of armatures, a plurality of printing wires each supported by a respective said armature, an assembly forming a magnetic flux circuit and supporting said leaf spring in a cantilever manner, said assembly including a core structure, a permanent magnet creating flux to urge said armatures toward said core structure against a biasing force of said leaf spring, and coil means associated with said core structure for creating flux to cancel said flux of said permanent magnet to allow said leaf spring to move said armatures away from said core structure and thus move said printing wires in a printing direction, guide means for guiding movement of said printing wires, and lubrication means for supplying lubricating oil to said wires to prevent wear between said printing wires and said guide means, the improvement comprising means for preventing flow of oil along said printing wires toward said armatures and said leaf spring, said preventing means comprising:

a member formed of an oil absorbing material positioned between said armatures and said lubrication means and said guide means, said member having an annular surface directly contacting said printing wires said annular surface converging in a direction away from said armatures and having a larger annular dimension directed toward said armatures and a smaller annular dimension directed away from said armatures.

2. The improvement claimed in claim 1, wherein said annular surface comprises a frusto-conical outer surface of said member.

3. The improvement claimed in claim 1, wherein said member has therethrough an opening, and said annular surface comprises a frusto-conical inner surface defining said opening.

4. The improvement claimed in claim 1, wherein said material of said member comprises felt.

5. The improvement claimed in claim 1, wherein said printing head further comprises a sheet of material positioned between said core structure and said leaf spring for preventing wear thereof, and said member comprises means for preventing oil from flowing to and collecting on said sheet, and thereby for avoiding sticking between said sheet and said leaf spring that otherwise would be caused by such collected oil.

* * * * *